US006827071B2

(12) United States Patent
Eason

(10) Patent No.: US 6,827,071 B2
(45) Date of Patent: Dec. 7, 2004

(54) WHEEL DRESSER FOR GRINDING WHEEL

(75) Inventor: Allan E. Eason, 7305 Rte. 2 South, Oregon, IL (US) 61061

(73) Assignee: Allan E. Eason

( * ) Notice: Subject to any disclaimer, the term of this patent is extended or adjusted under 35 U.S.C. 154(b) by 0 days.

(21) Appl. No.: 10/346,410

(22) Filed: Jan. 17, 2003

(65) Prior Publication Data

US 2004/0139956 A1 Jul. 22, 2004

(51) Int. Cl.[7] ..... B24B 53/00
(52) U.S. Cl. ..... 125/11.01; 451/72
(58) Field of Search ..... 125/11.01, 11.14, 125/11.18; 451/72, 56

(56) References Cited

U.S. PATENT DOCUMENTS

| | | | | |
|---|---|---|---|---|
| 2,957,471 A | | 10/1960 | Kent | |
| 3,221,727 A | | 12/1965 | Pitcl et al. | |
| 3,244,162 A | | 4/1966 | Rademacher | |
| 3,526,060 A | | 9/1970 | Hall et al. | |
| 3,532,084 A | | 10/1970 | Swenson | |
| 3,568,656 A | | 3/1971 | Bliznak | |
| 3,672,856 A | | 6/1972 | Rubenstein | |
| 3,870,030 A | | 3/1975 | Sollami | |
| 3,938,492 A | | 2/1976 | Mercer, Jr. | |
| 4,459,969 A | | 7/1984 | Russ | |
| 4,897,967 A | * | 2/1990 | Maruyama et al. | 451/5 |
| 5,441,449 A | | 8/1995 | Hart | |
| 5,951,387 A | * | 9/1999 | Wen | 451/443 |
| 6,116,989 A | * | 9/2000 | Balastik | 451/72 |

* cited by examiner

*Primary Examiner*—Dung Van Nguyen

(57) ABSTRACT

A dresser wheel mounted on the column of a grinder is presented. The dresser has an x-axis adjustment for positioning the diamond tool along the x-axis and a y-axis adjustment mechanism attached to the x-axis adjustment mechanism for positioning the diamond tool along the y-axis. An angular rotational mechanism attached to the y-axis adjustment mechanism moves along the y axis in response to operation of the y-axis adjustment mechanism. The diamond tool is held in a slot of an arm that is connected to a frame that is connected to and rotates about the angular rotational mechanism. A micrometer is attached to the arm with one end of the micrometer in contact with the frame. The arm moves along an axis in response to a change in the micrometer setting. A dead stop hinged to the arm sets the diamond tool to a calibrated position.

22 Claims, 10 Drawing Sheets

WHEEL DRESSER FOR GRINDING WHEEL

FIELD OF THE INVENTION

The present invention relates generally to grinding wheels, and more particularly relates to grinder wheel dressers.

BACKGROUND OF THE INVENTION

The operating surface of a grinding wheel will become worn over time with use. The grinding wheel has small cutting edges on the grains of the grinding wheel that must be kept sharp to give a free cut and to produce a satisfactory finish on the work. Wheel dressing is the process of re-sharpening the tiny cutting edges. Typically, a hard diamond point of a dressing tool is used to sharpen the grinding wheel. The hard diamond point fractures the grains of the wheel and/or removes the dull grains entirely and thus produces new, sharp edges. It also cleans out the tiny spaces between the grains removing metallic dust and other particles which eventually clogs up the wheel face and makes it dull.

There are currently a number of dressing tools that perform the task of wheel dressing. These dressing tools, also known as dressers, mount on the grinding table of the grinder wheel. Each time the wheel is dressed, the piece being worked on (i.e., the work piece) is taken off and replaced by the wheel dresser. The wheel dresser must be brought to the grinding wheel, which can be located a considerable distance away. After the grinding wheel is dressed, it may take valuable minutes to get the work piece located again. The down time of the grinding wheel wastes resources and increases the cost of grinding the work piece.

BRIEF SUMMARY OF THE INVENTION

The present invention provides a wheel dresser for dressing the surface of a grinding wheel. The dresser is mounted on the wheel column of the grinding wheel, allowing the dresser to always be in position.

The dresser wheel has an x-axis adjustment mounted on the spindle of a grinder for positioning the diamond tool along the x-axis. A y-axis adjustment mechanism attached to the x-axis adjustment mechanism positions the diamond tool along the y-axis. An angular rotational mechanism is attached to the y-axis adjustment mechanism and moves along the y axis in response to operation of the y-axis adjustment mechanism. The diamond tool is held in a slot of an arm that is connected to a frame. The frame is connected to the angular rotational mechanism and rotates about the angular rotational mechanism. The frame has an adjustment mechanism that moves the arm along an axis. A micrometer is attached to the arm with one end of the micrometer in contact with the frame. The arm moves along an axis generally perpendicular to the frame axis in response to a change in the micrometer setting. A dead stop hinged to the arm sets the diamond tool to a calibrated position.

The micrometer ranges from 0.5000 to 0.000 to 0.5000 and is used to set radii for dressing a grinding wheel with a convex or concave facing. Dialing the micrometer to the left of center sets the diamond tool for a convex radius. Dialing the micrometer to the right of center sets the diamond tool for a concave radius.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
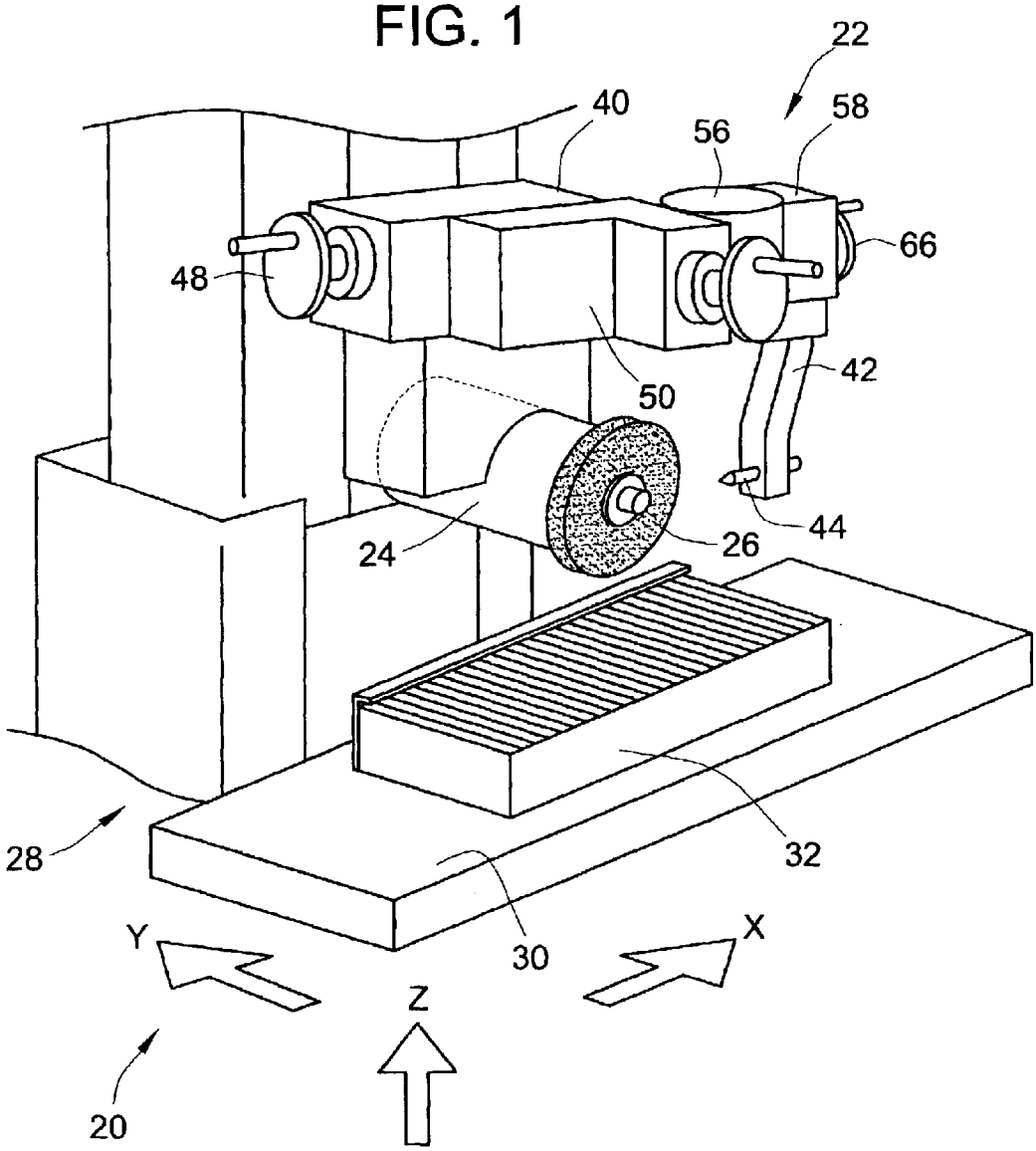
FIG. 1 shows a perspective view of the dresser wheel of the present invention mounted on a spindle of a grinding wheel.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning to the drawings, wherein like reference numerals refer to like elements, the invention is illustrated as being implemented in a suitable grinding tool environment 20. The dresser wheel 22 is mounted on the spindle 24 (i.e., column) of the grinding wheel 26 of a grinder 28. The grinder 28 includes moving table 30 and magnetic vise 32 upon which a work piece is mounted. The mounting of the dresser wheel 22 on the spindle 24 eliminates the need to remove and reposition the work piece every time the grinder 28 is dressed. This allows an operator to dress the grinding wheel 26 in seconds, while the table mounted dresser may take as long as fifteen minutes. The operation of the grinder 28 and the general operation of dressing the grinder are well known and need not be discussed herein. The dresser 22 moves up and down with the spindle 24 via the z-axis control of the grinder 28 (not shown).

FIG. 2 illustrates a top view of the dresser 22. The dresser 22 has an x-axis adjuster 40 which moves the arm 42 (and diamond tool 44) in the x axis direction as indicated by arrow 46. The location of the diamond tool 44 along the x-axis is controlled by turning the adjustment wheel 48 until the diamond tool 44 is at the desired position along the x-axis. When the adjustment wheel 48 is moved, the y axis adjustor 50 moves along the x-axis. The adjustment wheel 48 moves a ball screw or dovetail assembly that interconnects the x-axis adjustor 40 and y-axis adjustor 50. Movement of the ball screw or dovetail assembly causes the y axis adjustor to move along the x axis. The gross location of the diamond tool 44 along the y-axis (indicated by arrow 52) is controlled by turning the adjustment wheel 54 until the arm 42 that is attached to rotation frame 58 is at the desired position along the y-axis. The adjustment wheel 54 moves a ball screw or dovetail assembly that interconnects the y-axis adjustor 50 and angular adjustment mechanism 56. Movement of the ball screw or dovetail assembly causes the angular adjustment mechanism 56 to move along the y axis, thereby moving the rotation frame 58 and arm 42. The x-axis adjuster 40 and y-axis adjuster 50 essentially forms a two-way cross slide that allows the dresser 22 to be positioned for small to large diameter grinding wheels and/or narrow to wide grinding wheels. The rotation frame 58 is connected to the angular rotational hinge mechanism 56 via a bait mechanism with two flat pin bearings located internally to the angular adjustment mechanism. The flat pin bearings allow the rotation frame 58 to be rotated around pivot point 110.

Figure 6:
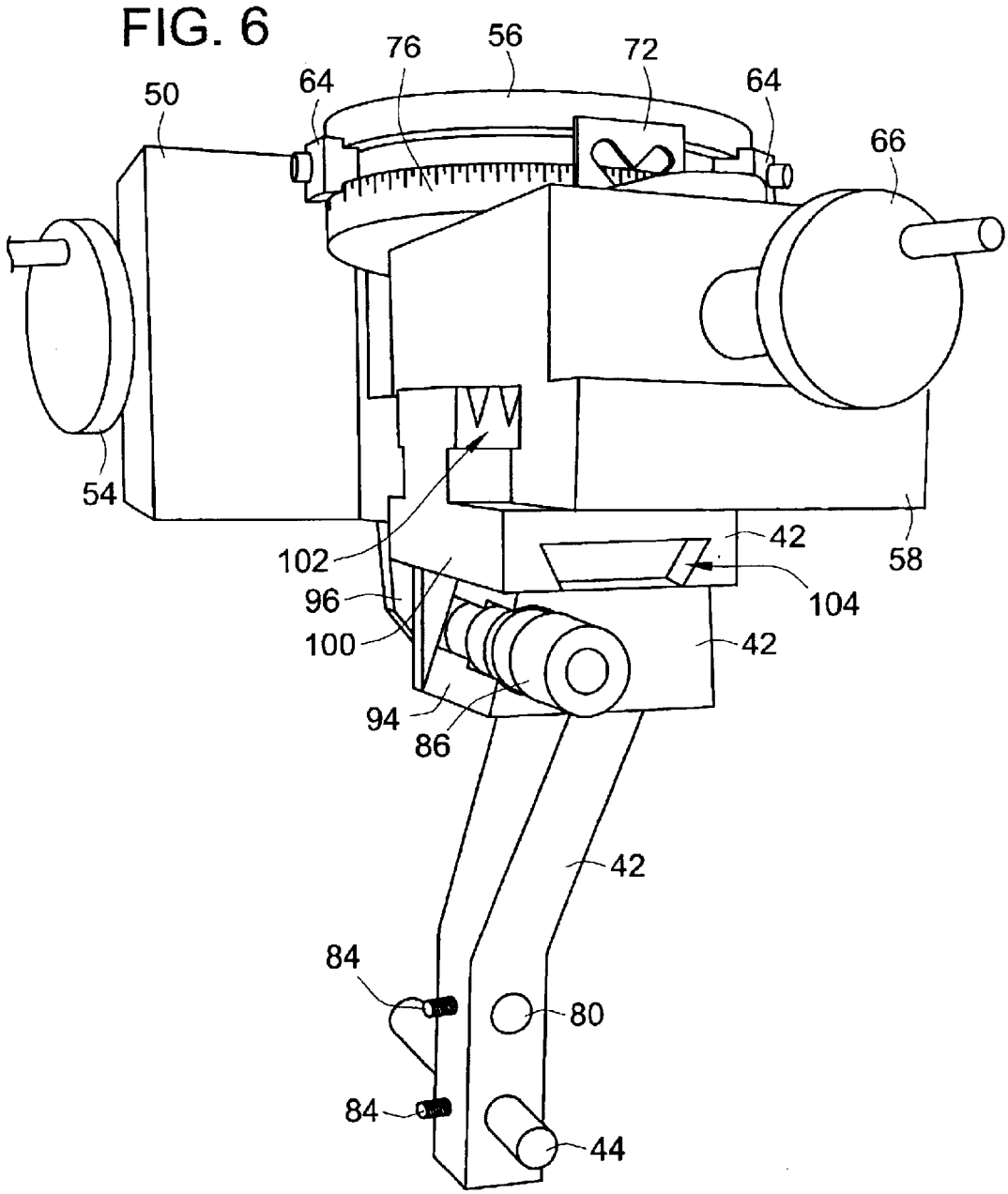
FIG. 6 is a perspective view of the rotation frame and arm of the dresser wheel of the present invention.

Once at the desired location, the arm 42 (and thereby diamond tool 44) may be positioned at an angle with respect to the grinding wheel 26 by moving the rotation frame 58 around angular rotational hinge mechanism 56 as represented by arrows 60, 62. Movable stops 64 are used to limit the angular position of rotation frame 58. The stops 64 can be set from 0 to 95 degrees in each direction. The arm 42 may be moved with respect to rotation frame 58 by rotating wheel 66. Rotation of wheel 66 causes the arm to move in the direction of arrow 68 or arrow 70 depending on the direction that wheel 66 is rotated. The arm 42 has an upper portion 100 that is connected to the rotation frame 58 (see FIG. 6). A track mechanism 102 interconnecting the upper portion 100 and rotation frame 58 is used to move the arm 42. In a preferred embodiment, the track mechanism 100 is a bevel gear and rack. This allows the diamond tool 44 to be moved along the width W of the grinding wheel 26 and create a chamfer as described herein.

Figure 3:
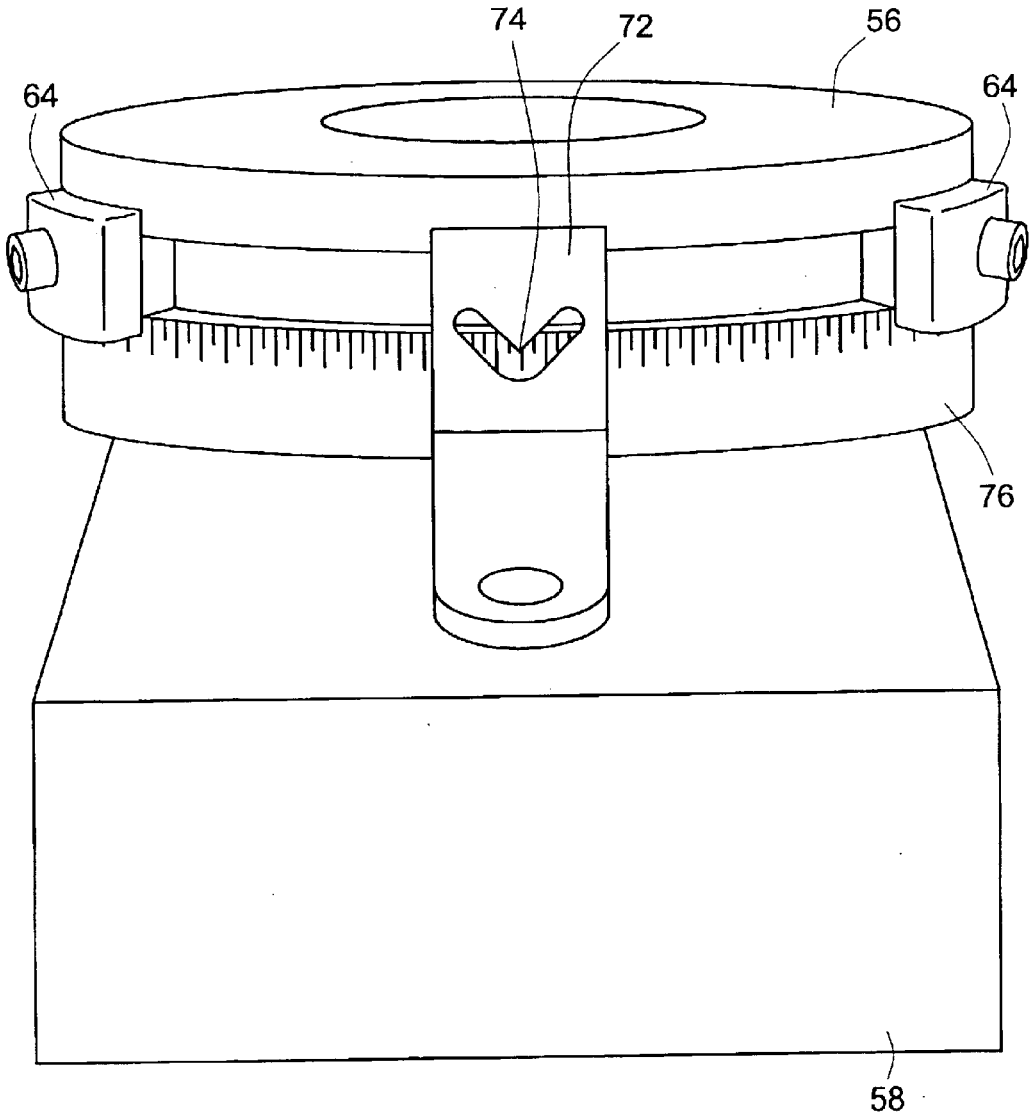
FIG. 3 is a perspective view of the adjustable angle stop mechanism of the dresser wheel.

During the dressing operation, the diamond tool 44 is moved into position by moving y-axis adjustor 50 via adjustment wheel 54 and moving angular rotational hinge mechanism 56 and rotation frame 58 via adjustment wheel 54 until the diamond is at the desired x-axis and y-axis position. If an angular adjustment is needed, the rotation frame 58 is moved to a desired angular position. Rotational angle indicator 72 (see FIG. 3) is used to align the rotation frame 58 at a desired angular position by moving the rotation frame until the position desired is lined up in sight 74. Scale 76 denotes the angular position of the arm 42. The rotational angle indicator 72 is mounted to rotation frame 58. In one embodiment, the rotation is accomplished with a bevel gear and rack.

Figure 4:
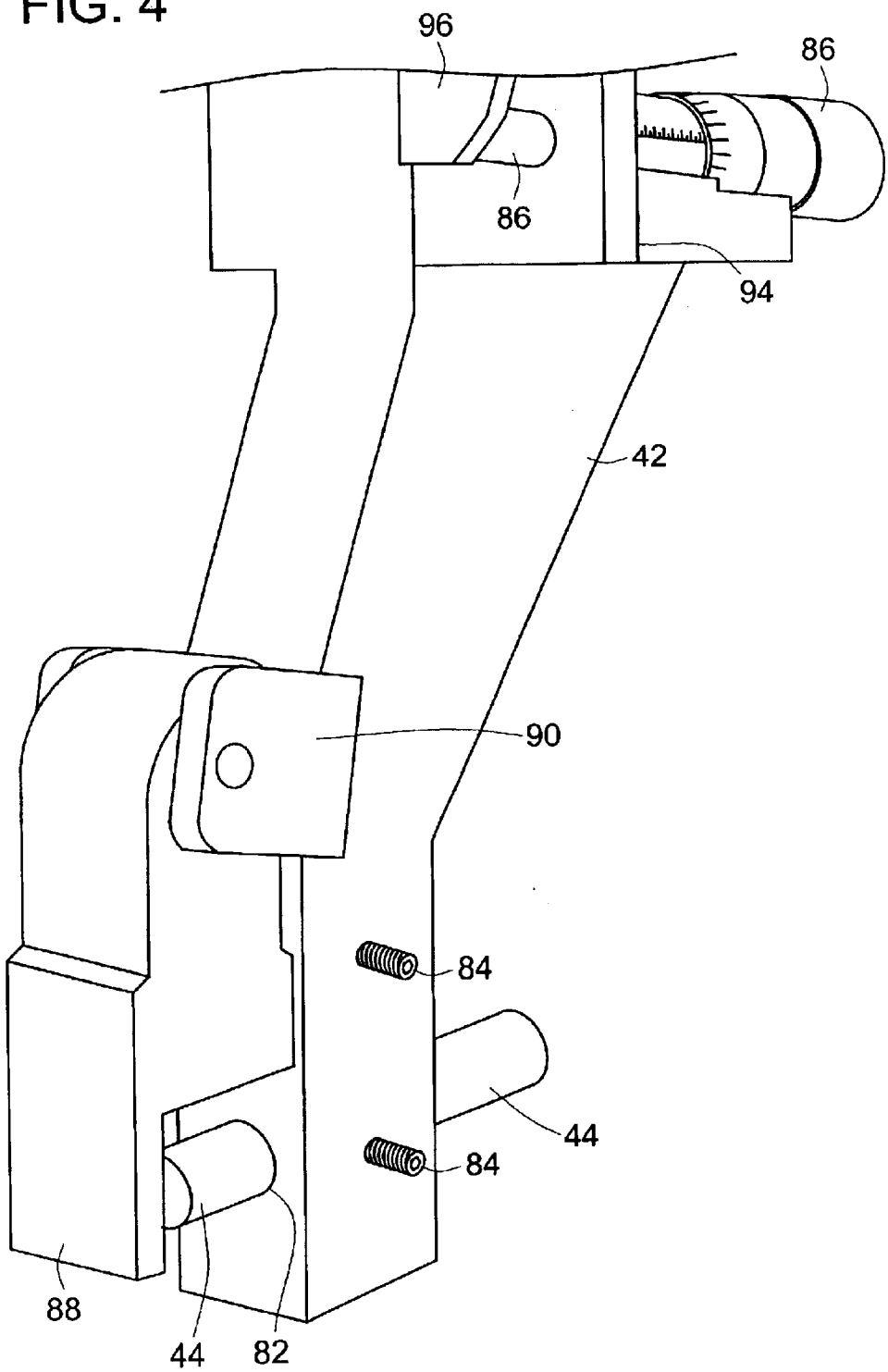
FIG. 4 is a perspective view of the micrometer and dead stop of the dresser wheel of the present invention with the stop in the zero position.
Figure 5:
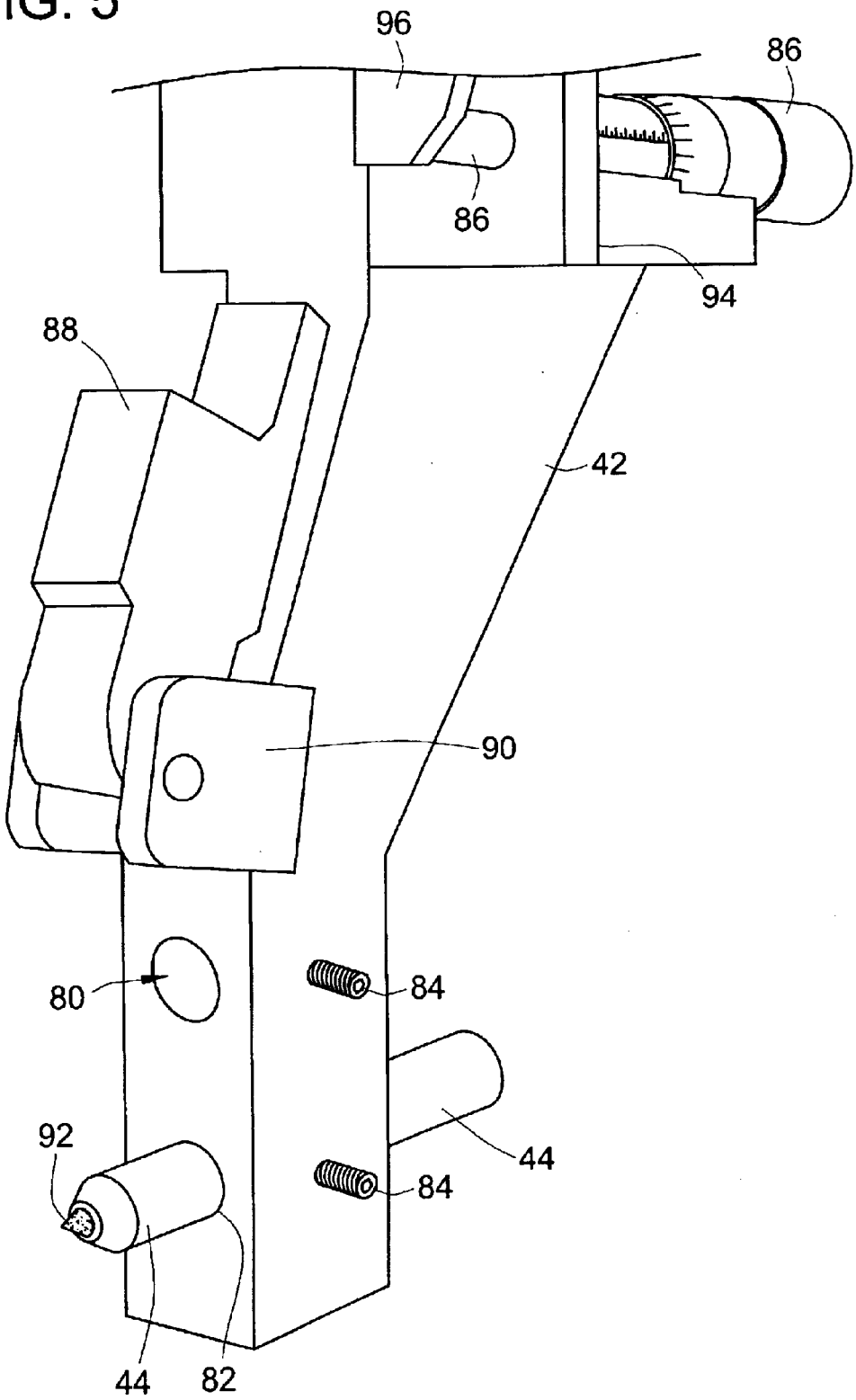
FIG. 5 is a perspective view of the micrometer and dead stop of the dresser wheel of the present invention with the dead stop in an up position.

The dresser wheel 22 provides the capability to sharpen the grinding wheel 26 in a variety of ways. These ways include straight surface facing, convex radius facing, concave radius facing, chamfer facing, convex radius corner facing, and concave radius corner facing. Prior to performing any facing, the diamond tool 44 is located. Turning to FIGS. 4 and 5,, the diamond tool 44 is placed in the proper slot 80, 82. Slot 80 is used for facing operations where precise measurements are not needed. For example, the diamond tool 44 is placed in slot 80 for straight surface facing. Slot 82 is also used for straight surfaces and when precision measurements are needed. The diamond tool 44 is held in place with removable set screws 84.

When precision grinding is needed, micrometer 86 is used to position the diamond tool 44. In a preferred embodiment, the micrometer 86 is a standard one inch micrometer that ranges from 0.500 to 0.000 and 0.500 (i.e., ±0.500). The diamond tool 44 is first set to a zero degree position with respect to the micrometer 86. This is accomplished with a dead stop 88 connected to arm 42 by hinge 90. The dead stop 88 is held in a down position against the arm 42 and the diamond tool 44 is positioned in slot 82 such that the diamond tip 92 touches the dead stop 88. The diamond tool 44 is then held in place with set screw 84. Once the diamond tool 44 is positioned, the dead stop 88 is moved out of the way (see FIG. 5). The micrometer 86 is attached to rotation frame 58 with bracket 94. The end of the micrometer 86 is positioned against stop 96. When the end of the micrometer is moved in the direction of arrow 98 by rotation of the micrometer 86, the arm 42 moves in relation to rotation frame 58. In a preferred embodiment, upper portion 100 and the remainder of the arm 42 are interconnected in a dovetail arrangement where the dovetail mechanism 104 moves in response to rotation of the micrometer 86 (see FIG. 6).

Figures 2A, 2B:
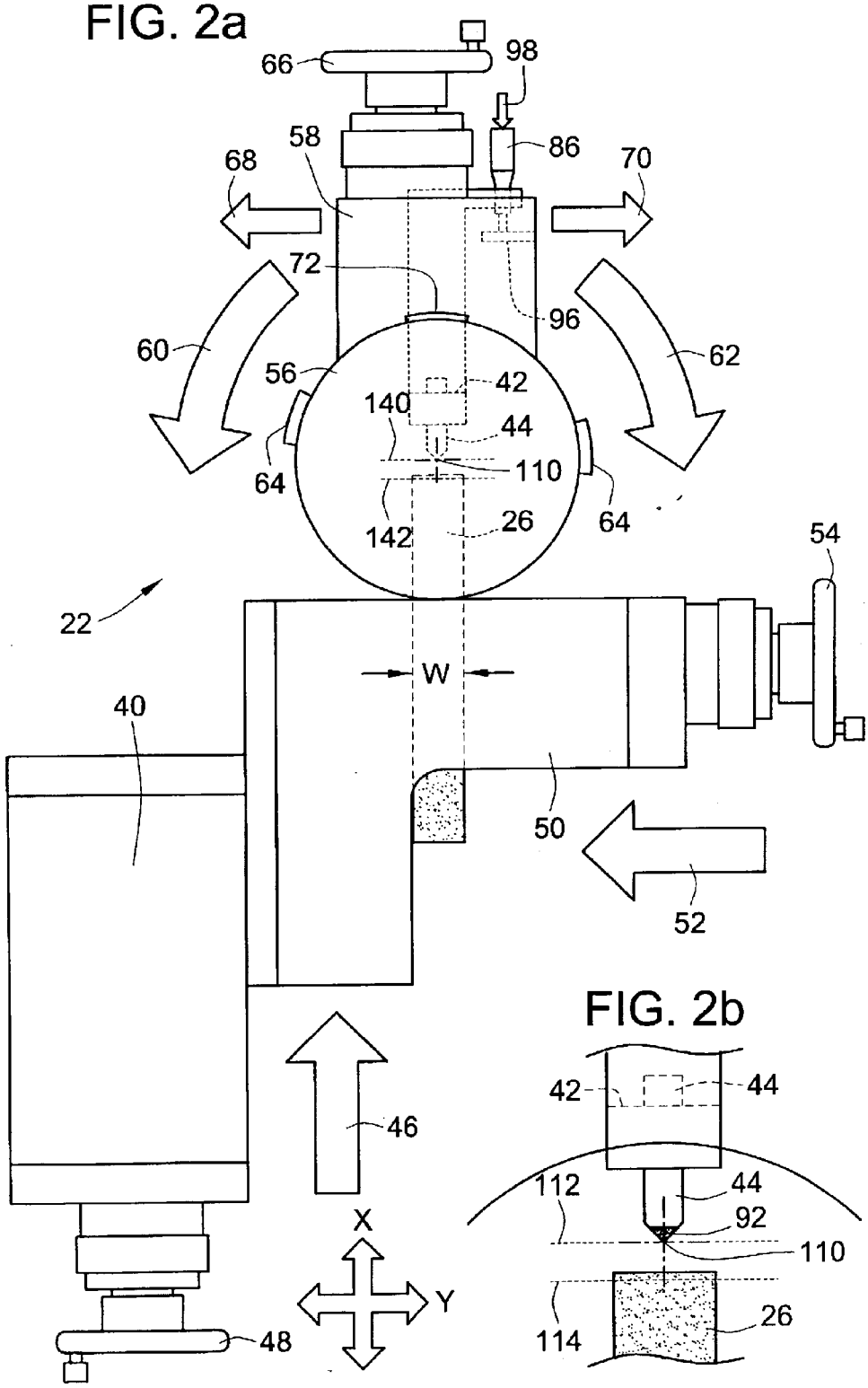
FIG. 2*a* is a top level view of the dresser wheel of FIG. 1 illustrating the dresser wheel surface facing a grinding wheel.
FIG. 2*b* is an enlarged view of the diamond tool portion of the dresser wheel of FIG. 2*a;*

As previously mentioned, the dresser 22 can sharpen the grinding wheel 26 in a variety of ways including straight surface facing, convex radius facing, concave radius facing, chamfer facing, convex radius corner facing, and concave radius corner facing. Surface facing is illustrated in FIGS. 2*a* and 2*b*. Pivot point 110 is shown to indicate the pivot point of rotation frame 58 with respect to angular rotation mechanism 56. The diamond tool 44 is placed in slot 80 or 82 and moved into a starting position 112 with respect to grinding wheel 26 by moving the y axis adjustor 50 via adjustment wheel 48 and the rotation frame 58 and arm 42 via adjustment wheel 54. Once at the starting position 112, the diamond tool 44 is moved back and forth in the direction of arrows 68, 70 across the surface of the grinding wheel 26. Position limit blocks may be used to limit the movement of the diamond tool in the directions of arrows 68, 60. The arm 42 (and the diamond tool 44) is then moved towards position 114 in by dialing the micrometer 86 (or the adjustment wheel 48) to a new position. The process of moving the diamond tool 44 back and forth in the direction of arrows 68, 70 and moving the arm 42 towards position 114 is repeated until the grinding wheel surface is at the desired sharpness and flatness.

Figures 7A, 7B:
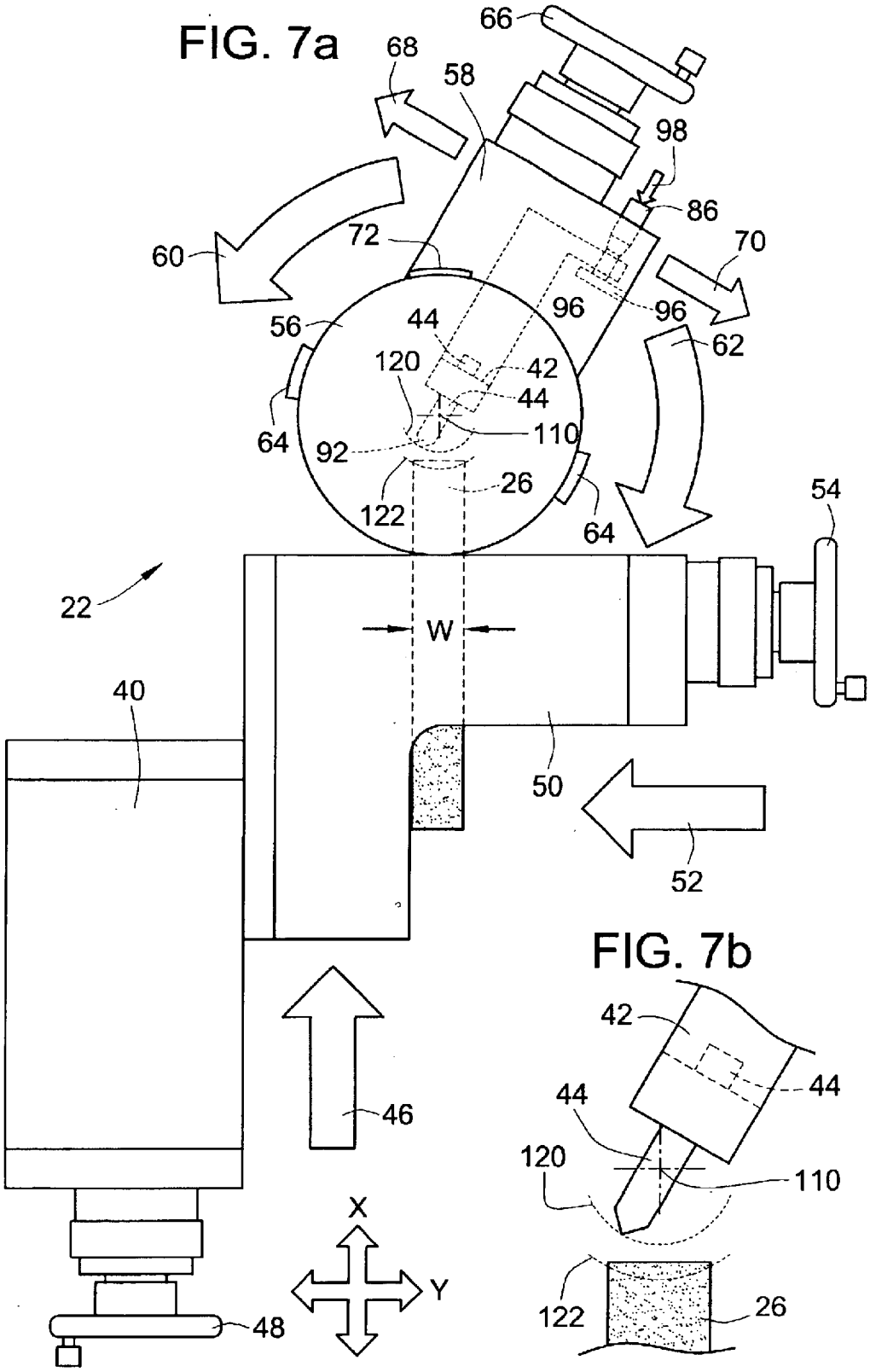
FIG. 7*a* is a top level view of the dresser wheel of FIG. 1 illustrating the dresser wheel facing a grinding wheel with a concave radius in accordance with the teachings of the present invention.
FIG. 7*b* is an enlarged view of the diamond tool portion of the dresser wheel of FIG. 7*a;*

FIGS. 7*a* and 7*b* show the dresser wheel 22 creating a concave facing of the grinding wheel 28. The diamond tool 44 is positioned such that the pivot point 110 is on the diamond tool 44 behind the diamond tip 92 at starting point 120. The rotation frame 58 is rotated in the directions of arrows 60, 62 so that the diamond tool 44 moves across the face of the grinding wheel 26. The diamond tool 44 is then moved towards position 122 in predefined increments via the rotation of micrometer 86 from the 0.000 position towards the +0.500 position (i.e., to the left of center). The rotation frame 58 is then rotated in the directions of arrows 60, 62 so that the diamond tool 44 moves across the face of the grinding wheel 26. The process of rotating the rotation frame 58 and moving the diamond tool 44 is repeated until the desired concave facing is reached.

Figures 8A, 8B:
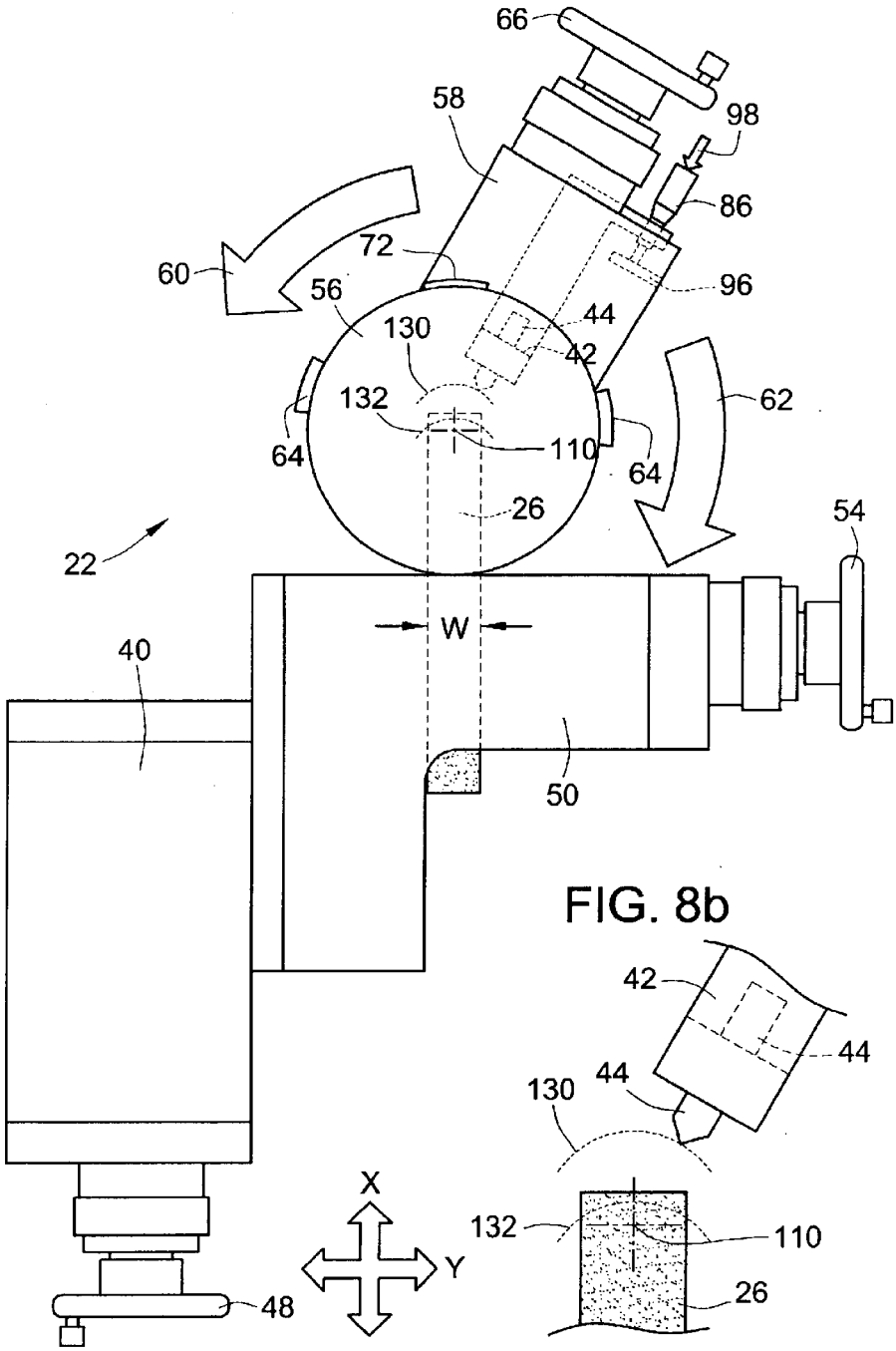
FIG. 8*a* is a top level view of the dresser wheel of FIG. 1 illustrating the dresser wheel facing a grinding wheel with a convex radius in accordance with the teachings of the present invention.
FIG. 8*b* is an enlarged view of the diamond tool portion of the dresser wheel of FIG. 8*a;*

FIGS. 8*a* and 8*b* show the dresser wheel 22 creating a convex facing of the grinding wheel 26. The diamond tool 44 is positioned such that the pivot point 110 is on the grinding wheel 26 at starting point 130. The rotation frame 58 is rotated in the directions of arrows 60, 62 so that the diamond tool 44 moves across the face of the grinding wheel 28. The diamond tool 44 is then moved towards position 132 in a predefined increment via the rotation of micrometer 86 from the 0.000 position towards the −0.500 position in the predefined increment (i.e., to the right of center). The rotation frame 58 is then rotated in the directions of arrows 60, 62 so that the diamond tool 44 moves across the face of the grinding wheel 28. The process of rotating the rotation frame 58 and moving the diamond tool 44 is repeated until the desired convex facing is reached.

Figures 9A, 9B:
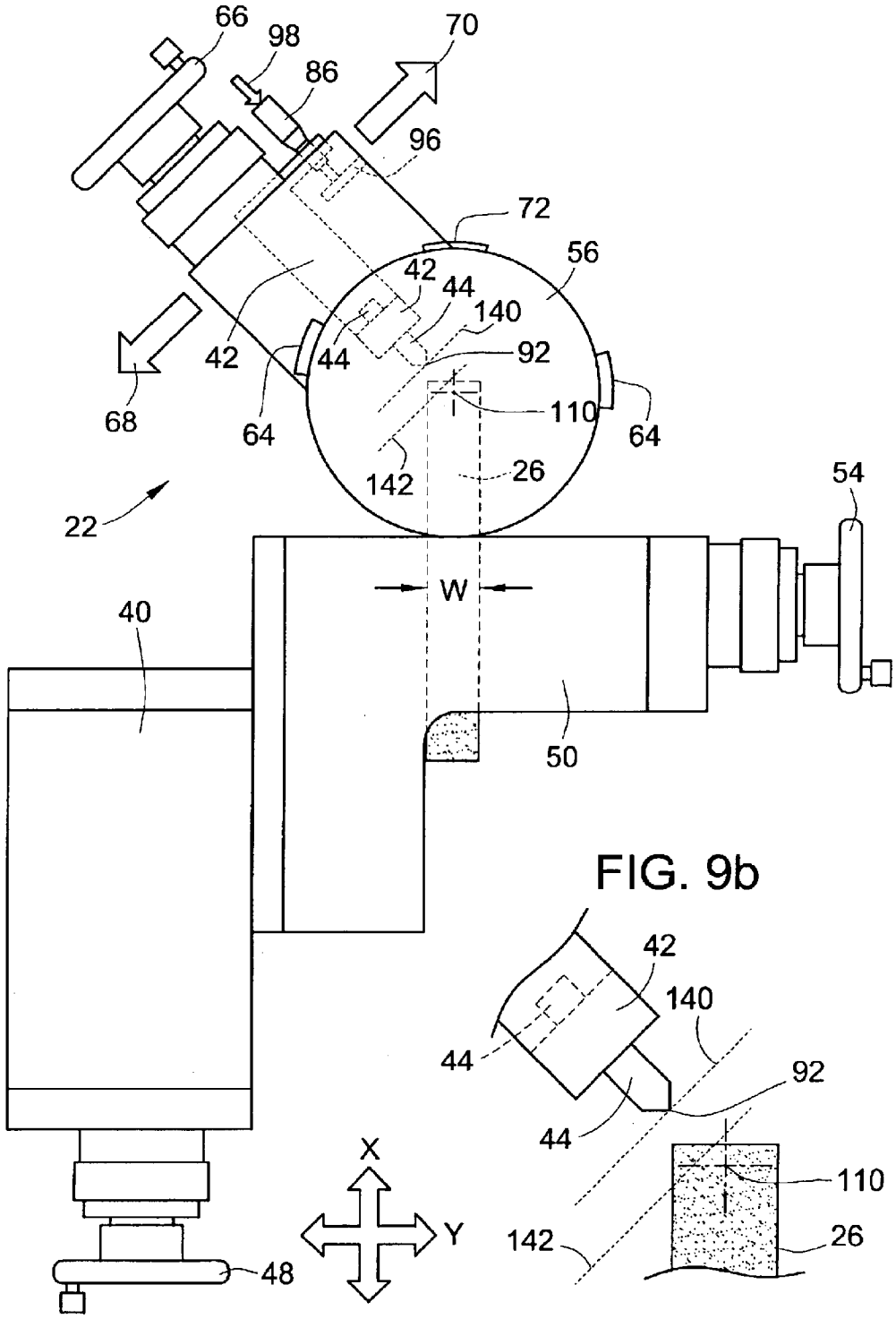
FIG. 9*a* is a top level view of the dresser wheel of FIG. 1 illustrating the dresser wheel facing a grinding wheel with a chamfer in accordance with the teachings of the present invention.
FIG. 9*b* is an enlarged view of the diamond tool portion of the dresser wheel of FIG. 9*a*.

FIGS. 9*a* and 9*b* illustrates the dresser wheel 22 being used to create a chamfer facing of the grinding wheel 26. The diamond tool 44 is placed at the desired chamfer angle with respect to the grinding wheel 26 by rotating rotation frame 58 to the desired angular position. The diamond tool 44 is moved to be near position 140 via rotation of adjustment wheels 48, 54. Once near position 140, the micrometer 86 is adjusted until the diamond point 92 contacts the grinding wheel 26. The diamond tool 44 is then moved back and forth in the directions of arrows 68, 70 via rotation of wheel 66. The micrometer 86 is then moved in a predetermined increment towards position 142 and the diamond tool 44 is moved back and forth in the direction of arrows 68, 70 via rotation of wheel 66. The process of moving the micrometer 86 and the diamond tool 44 back and forth in the direction of arrows 68, 70 is repeated until the desired depth and surface finish of the chamfer is achieved. The same process may then be repeated on the other side of the grinding wheel 26.

Figure 10:
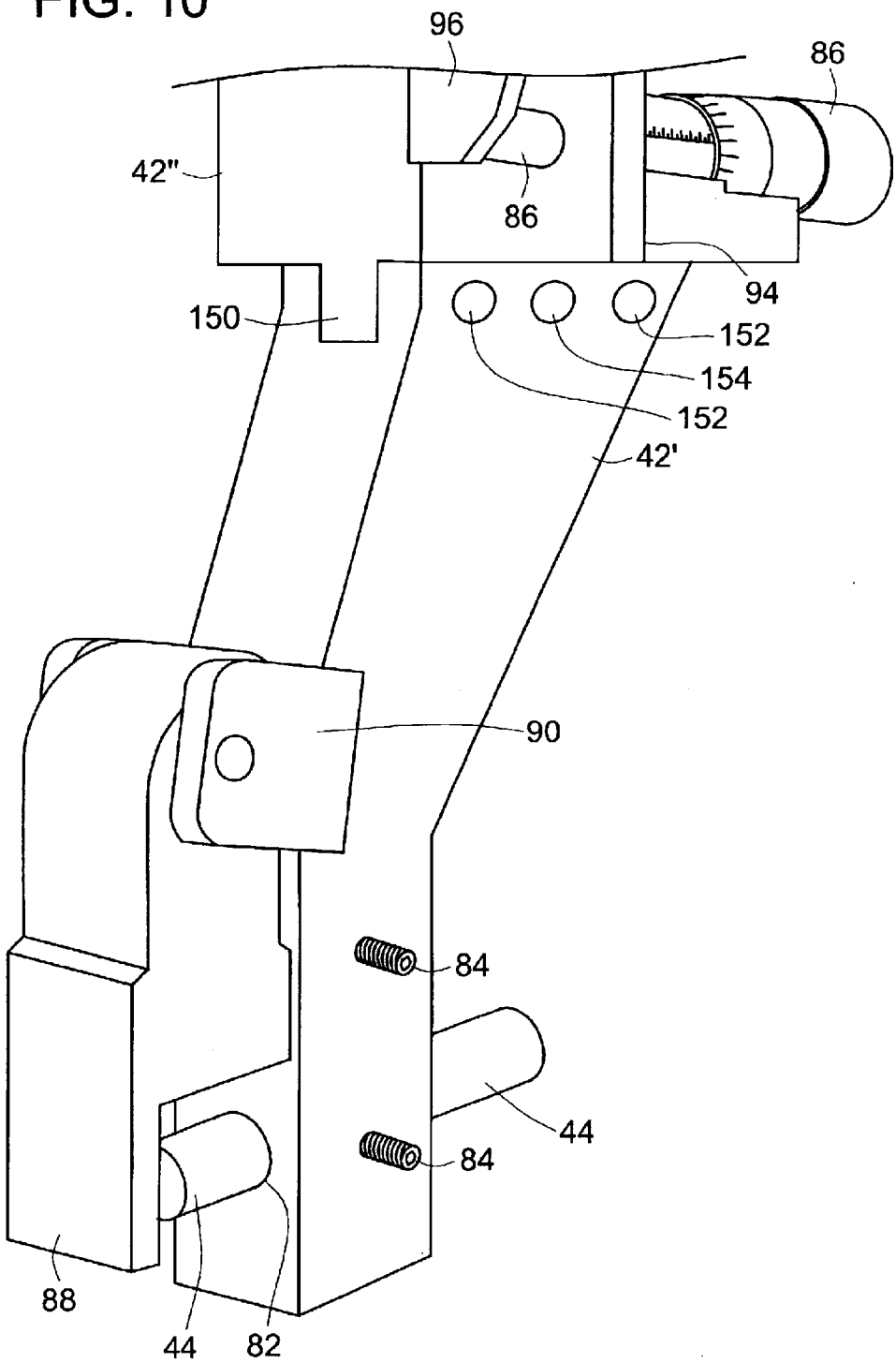
FIG. 10 is a perspective view of an alternate embodiment of the dresser wheel of the present invention where the arm is removable.

In some situations, it may be required that the arm be moved away from the grinding wheel 26. In an alternate embodiment shown in FIG. 10, a portion of the arm 42 is removable. The arm 42 comprises portion 42' and 42". Arm portion 42' is held into place with a tongue and groove arrangement 150. The arm 42' is positioned with locator holes 152 adaptable to receive pins and held in place with a locking mechanism 154 such as a set screw assembly. This allows the dresser to stay in place while grinding operations are being performed while keeping the dresser in the y position needed to dress the grinder.

The foregoing description of various embodiments of the invention has been presented for purposes of illustration and description. It is not intended to be exhaustive or to limit the invention to the precise embodiments disclosed. Numerous modifications or variations are possible in light of the above teachings. For example, the arm may be hinged to rotation frame 58 to allow the arm to be moved out of the way when the grinding wheel is not being dressed. This allows the dresser to stay in place while grinding operations are being performed while keeping the dresser in the x-y position needed to dress the grinder. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A dresser wheel for mounting on a spindle of a grinder comprising:

a first adjustment mechanism mounted to the spindle of the grinder for positioning a diamond tool along a first axis;

a two-way cross slide mechanism slidably attached to the first adjustment mechanism, the two-way cross slide having a second adjustment mechanism for positioning the diamond tool along a second axis that is generally perpendicular to the first axis, the two-way cross-slide moving along the first axis in response to operation of the first adjustment mechanism;

an angular rotational hinge mechanism attached to the two-way cross slide mechanism, the angular rotational hinge mechanism moving along the second axis in response to operation of the second adjustment mechanism;

a frame connected to the angular rotational hinge mechanism and rotatable about the angular rotational mechanism, the frame having a third adjustment mechanism;

an arm movably connected to the frame; the arm having at least one slot for receiving a diamond tool and moving along a third axis in response to operation of the third adjustment mechanism; and a micrometer attached to the arm, one end of the micrometer in contact with the frame, the arm moving along a fourth axis generally perpendicular to the third axis in response to a change in the micrometer setting.

2. The dresser wheel of claim 1 further comprising a dead stop attached to the arm for positioning the diamond tool at a zero position.

3. The dresser wheel of claim 2 wherein the dead stop is attached to the arm with a hinge.

4. The dresser wheel of claim 1 wherein the micrometer sets a grinding radius for creating one of a convex facing and a concave facing.

5. The dresser wheel of claim 1 wherein the arm is movably connected to the rotation frame with a track mechanism.

6. The dresser wheel of claim 5 wherein the track mechanism comprises a bevel gear and rack.

7. The dresser wheel of claim 1 wherein the first adjustment mechanism includes a ball screw.

8. The dresser wheel of claim 1 wherein the angular rotation mechanism includes at least one slidable stop.

9. The dresser wheel of claim 8 wherein the at least one slidable stop can be set from 0 to 95 degrees.

10. The dresser wheel of claim 8 wherein the angular rotation mechanism further includes an angle indicator.

11. The dresser wheel of claim 1 wherein the arm is removable.

12. The dresser wheel of claim 11 wherein the arm comprises an upper portion connected to a lower portion, the upper portion having one of a tongue and a groove and the lower portion having the other of the tongue and groove.

13. A dresser wheel for mounting on a spindle of a grinder comprising:

a first adjustment mechanism mounted to the spindle of the grinder for positioning a diamond tool along a first axis;

a second adjustment mechanism attached to the first adjustment mechanism for positioning the diamond tool along a second axis that is generally perpendicular to the first axis, the second adjustment mechanism moving along the first axis in response to operation of the first adjustment mechanism;

an arm connected to the second adjustment mechanism; the arm having at least one slot for receiving a diamond tool; and a micrometer attached to the arm, the arm moving along a third axis in response to a change in the micrometer setting.

14. The dresser wheel of claim 13 further comprising an angular rotational mechanism attached to the second adjustment mechanism and the arm and located between the second adjustment mechanism and the arm, the angular rotational mechanism moving along the second axis in response to operation of the second adjustment mechanism and wherein the arm is rotatable about the angular rotational mechanism.

15. The dresser wheel of claim 14 further comprising a frame connected to the angular rotational mechanism and the arm and located between the angular rotational mechanism and the arm and rotatable about the angular rotational mechanism, the frame having a third adjustment mechanism and wherein an end of the micrometer contacts the frame and the arm moves along a fourth axis in response to operation of the third adjustment mechanism, the fourth axis generally perpendicular to the third axis.

16. The dresser wheel of claim 13 further comprising a dead stop attached to the arm.

17. The dresser wheel of claim 13 wherein the arm is removable.

18. The dresser wheel of claim 17 wherein the arm comprises an upper portion connected to a lower portion, the upper portion having one of a tongue and a groove and the lower portion having the other of the tongue and groove.

19. The dresser wheel of claim 18 wherein the arm further includes a hole at each slot for receiving a locking mechanism.

20. The dresser wheel of claim 19 wherein the locking mechanism comprises a set screw.

21. The dresser wheel of claim 13 wherein the micrometer sets a grinding radius for creating one of a convex facing and a concave facing on the grinding wheel.

22. The dresser wheel of claim 21 wherein the micrometer has a setting range of ±0.500 inches.

* * * * *